US005340222A

United States Patent [19]

Tanaka et al.

[11] Patent Number: 5,340,222

[45] Date of Patent: Aug. 23, 1994

[54] INK RIBBON WITH WIRE LUBRICANT IN A WIRE IMPACT PRINTER

[75] Inventors: Minoru Tanaka; Shigeki Mizuno; Masaki Shimomura, all of Suwa, Japan

[73] Assignee: Seiko Epson Corporation, Tokyo, Japan

[21] Appl. No.: 981,744

[22] Filed: Nov. 24, 1992

[30] Foreign Application Priority Data

Nov. 25, 1991 [JP] Japan ..... 3-096513
May 21, 1992 [JP] Japan ..... 4-128806

[51] Int. Cl.[5] ..... B41J 2/265; B41M 5/00

[52] U.S. Cl. ..... 400/124.25; 400/237; 106/23 R; 252/11

[58] Field of Search ..... 400/124, 124 IW, 241, 400/241.1, 241.2, 237; 252/9, 11, 32, 32.5, 58, 49.9; 106/20, 22, 23

[56] References Cited

U.S. PATENT DOCUMENTS

| | | | |
|---|---|---|---|
| 3,987,883 | 10/1976 | Darwin et al. | 400/124 |
| 4,643,599 | 2/1987 | Taguchi | 400/124 IW |
| 4,770,797 | 9/1988 | Syracuse et al. | 252/12 |
| 4,923,625 | 5/1990 | King | 252/32.5 |
| 4,941,923 | 7/1990 | Sotogoshi et al. | 106/498 |
| 5,017,029 | 5/1991 | Andou et al. | 400/241 |
| 5,043,085 | 8/1991 | Kinoshita et al. | 252/49.9 |
| 5,059,334 | 10/1991 | Scheld | 252/32.5 |
| 5,135,803 | 8/1992 | Tanaka et al. | 400/241.1 |

FOREIGN PATENT DOCUMENTS

| | | | |
|---|---|---|---|
| 297184 | 12/1986 | Japan | 400/241 |
| 7351 | 8/1990 | Japan . | |
| 99645 | 1/1991 | Japan . | |

OTHER PUBLICATIONS

Patent Abstracts of Japan, vol. 5, No. 25 (M-55) (697) Feb. 14, 1981.

Conley, W. J. et al., "Porous Print . . . " IBM Technical Disclosure Bulletin vol. 21, No. 1, Jun. 1978.

Connor, A. et al., "Oil Flow Restrictor" IBM Technical Disclosure Bulletin, vol. 25, No. 4, Sept. 1982.

Derwent Publications Ltd., DATABASE WPIL, Week 8913, London, GB, Feb. 1989.

*Primary Examiner*—David A. Wiecking

*Attorney, Agent, or Firm*—Ladas & Parry

[57] ABSTRACT

The present invention provides an impact dot printer free from the missing of dots.

An impact dot printer for recording dots on a recording medium comprises a printer wire having a printer end, a guide member for supporting the printing wire, an ink ribbon which contains an ink composition comprising a dye and a solvent and is positioned between the printing end of the printing wire and the recording medium. The printer also has a lubricant containg an oil component in the guide member for permitting the printing wire to be easily moved. The solubility of the solvent for the dye in the oil component of the lubricant is more than 400 g/100 g of oil.

11 Claims, 5 Drawing Sheets

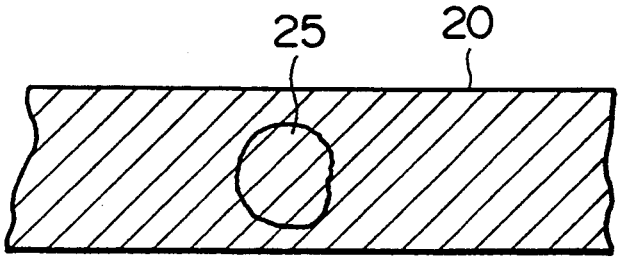
FIG. 2
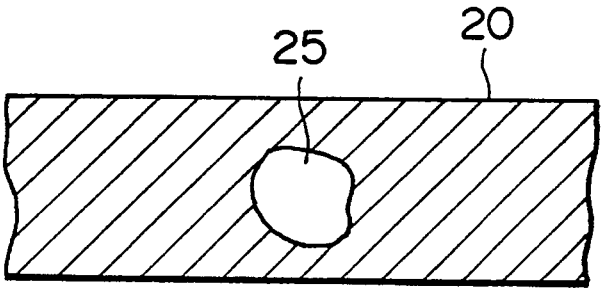
FIG. 3
CDEFGHIJKLMNOPQRSTUVWXYZ
DEFGHIJKLMNOPQRSTUVWXYZ[
EFGHIJKLMNOPQRSTUVWXYZ[\
GHIJKLMNOPQRSTUVWXYZ[\]
FIG. 4

INK RIBBON WITH WIRE LUBRICANT IN A WIRE IMPACT PRINTER

BACKGROUND OF THE INVENTION

1. Field of the Art

The present invention relates to an impact dot printer.

2. Background Art

Conventional impact dot printers known in the art are described in, for example, Japanese Patent Laid-Open Publication No. 7351/1991 and Japanese Utility Model Laid-Open Publication No. 99645/1990, all incorporated herein by reference. An enlarged view of these devices is shown in FIG. 6. When recording is conducted by means of an impact dot printer having such a head, there occurs such an unfavorable phenomenon that dots are missed as shown in FIG. 4. The missing of dots is remarkably detrimental to the reliability of the printer. As shown in FIG. 6, in the above-described conventional impact dot head, a component having a low viscosity of a lubricant 104 oozes out through the guide holes 102 and a gap between a head guide 101 and a guide supporting member 105 and adheres to an ink ribbon 106 to form an adhered portion 104a. An ink is missing from the adhered portion 104a. Even when a printing wire 103 conducts a printing action, the ink does not adhere to a recording medium 107, so that missing of dots unfavorably occurs.

SUMMARY OF THE INVENTION

The present inventors have conducted studies with a view to developing an impact dot printer free from missing of dot. As a result, we have found that a lubricant is greatly involved in the missing of dots.

Accordingly, an object of the present invention is to provide an impact dot printer free from the missing of dots.

According to the first aspect of the present invention, there is provided an impact dot printer for recording dots on a recording medium, comprising:

a printing wire having a printing end;

a guide member for supporting the printing wire, the guide member having a lubricant containing an oil component for permitting the printing wire to be easily moved;

an ink ribbon positioned between the printing end of the printing wire and the recording medium, the ink ribbon containing an ink composition comprising a dye and a solvent for the dye; and a drive means for driving the printing wire in response to a printing signal so that the printing end of the wire impacts the ink ribbon to the recording medium thereby recording a dot on the medium, wherein the solubility of the solvent for the dye in the oil component of the lubricant is not more than 400 g/100 g of oil.

According to the second aspect of the present invention, there is provided an ink ribbon for an impact dot printer which has a lubricant containing an oil component for permitting a printing wire to be easily moved, comprising:

a ribbon; and an ink composition comprising a dye and a solvent for the dye, the ink composition being impregnated into the ribbon, wherein the solubility of the solvent for the dye in the oil component of the lubricant is not more than 400 g/100 g of oil.

According to the third aspect of the present invention, there is provided an impact dot printer for recording dots on a recording medium, comprising:

a printing wire having a printing end;

a guide member for supporting the printing wire, said guide member having a lubricant for permitting the printing wire to be easily moved, the lubricant comprising a grease comprising an oil component and urea as a thickening agent;

an ink ribbon positioned between the printing end and the recording medium; and a drive means for driving the printing wire in response to a printing signal so that the printing end of the wire impacts the ink ribbon to the recording medium, thereby recording a dot on the medium.

According to the fourth aspect of the present invention, there is provided an impact dot printer for recording dots on a recording medium, comprising;

a printing wire having a printing end;

a guide member for supporting the printing wire having a black lubricant for permitting the printing wire to be easily moved;

an ink ribbon positioned between the printing end of the printing wire and the recording medium; and a drive means for driving the printing wire in response to a printing signal so that the printing end of the wire impacts the ink ribbon to the recording medium, thereby recording a dot on the medium.

BRIEF DESCRIPTION OF THE DRAWINGS

FIG. 2 is a diagram showing an ink ribbon to which an oil component of a lubricant adhered;

FIG. 3 is a diagram showing an ink ribbon in which an ink dye is partly missing due to the adhesion of an oil component of a lubricant;

FIG. 4 is a diagram showing a missing of dots caused by missing of an ink dye attributable to the adhesion of an oil component of a lubricant to an ink ribbon;

DETAILED DESCRIPTION OF THE INVENTION

Impact Dot Printer

The impact dot printer according to the present invention basically comprises a printing wire having a printing end, a guide member for supporting the printing wire, and ink ribbon which contains an ink composition and is positioned between the printing end of the printing wire and a recording medium, a drive means for driving the printing wire in response to a printing signal so that the printing end of the wire impacts the ink ribbon to the recording medium, thereby recording a dot on the medium. The printer also has a lubricant in the guide member for permitting the printing wire to be easily moved.

Figure 1:
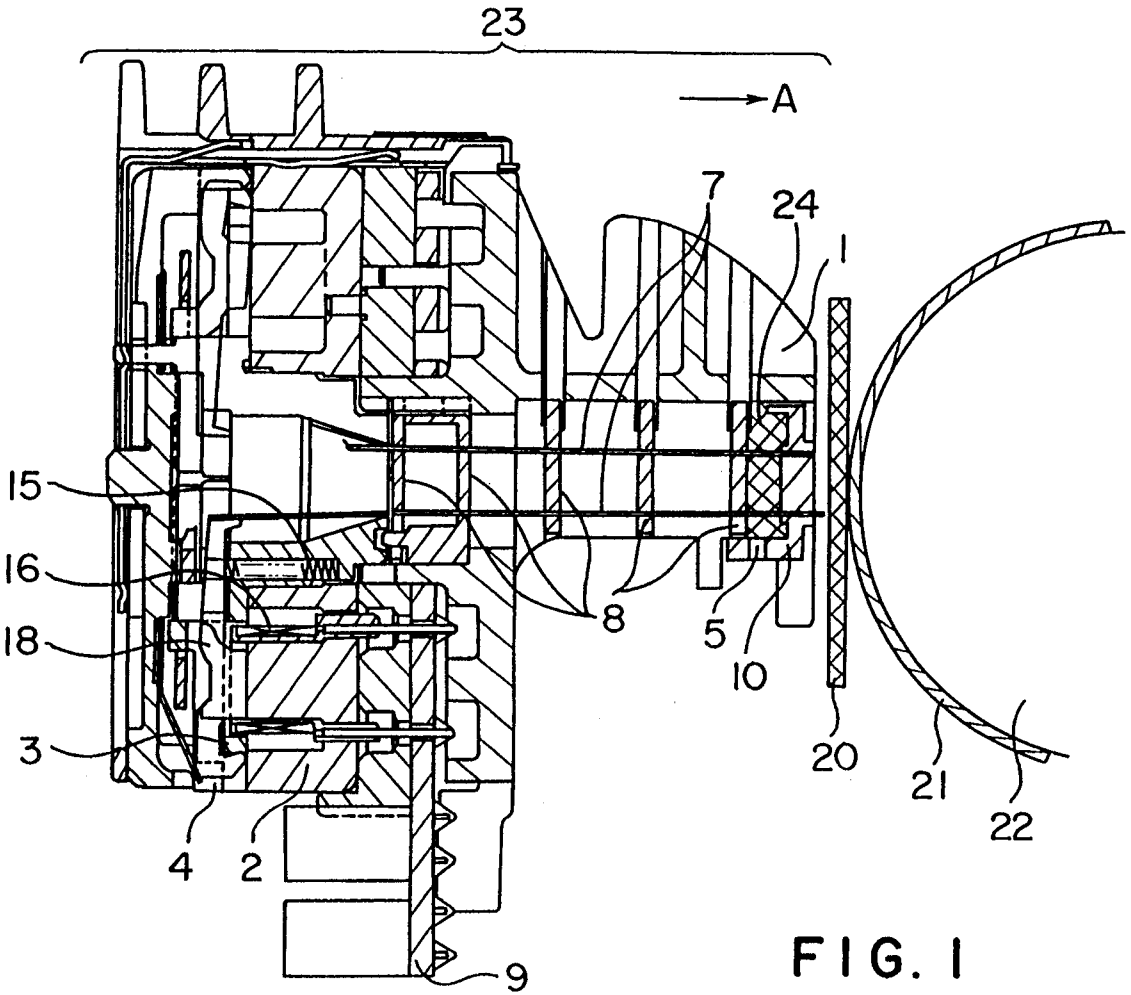
FIG. 1 is a cross-sectional view of a head of the impact dot printer according to the present invention.

An embodiment of a head in a device favorable for use as the impact dot printer according to the present invention is shown in FIG. 1.

FIG. 1 is a cross-sectional view of an impact dot head 23 wherein printing is conducted by projecting a printing wire 7 by an electromagnetic force. A coil 16 connected to a printed circuit, board 9 is selectively energized in response to a printing signal to generate a magnetic flux in a magnetic circuit comprising a frame 2, a first yoke 3, a second yoke 4 and a lever 18, so that the lever 18 is attracted in the direction indicated by an arrow A in FIG. 1. Consequently, the printing wire 7 engaged with the lever 18 is projected in the direction indicated by the arrow A and impacts an ink ribbon 20 to a printing paper 21 and a platen 22, so that dots are formed on the printing paper 21 to conduct printing. After the printing, the printing wire 7 is returned by the resiliency of the impact and a return spring 15 to a stand-by position, i.e., a position before the printing signal is transmitted. The printing wire 7 is guided and supported by an intermediate guide member 8 and a head guide 10 each fixed to a nose 1. A lubricant room 24 is a space defined by the head guide 10 fixed to the nose 1, the intermediate guide 8 which is in the closest proximity to the head guide 10, and the nose 1. A lubricant (for example, a grease) is injected into the lubricant room 24 through a lubricant injection port 5. The lubricant reduces a sliding friction of the printing wire 7 and, at the same time, to prevent an ink, a flock of a ribbon, a paper dust or the like from entering the inside of an impact dot head 23.

The ink ribbon 20 comprises a ribbon (for example, a synthetic fiber comprising a polyamide or the like) impregnated with an ink comprising a solution or dispersion of an ink dye in a solvent.

Figure 7:
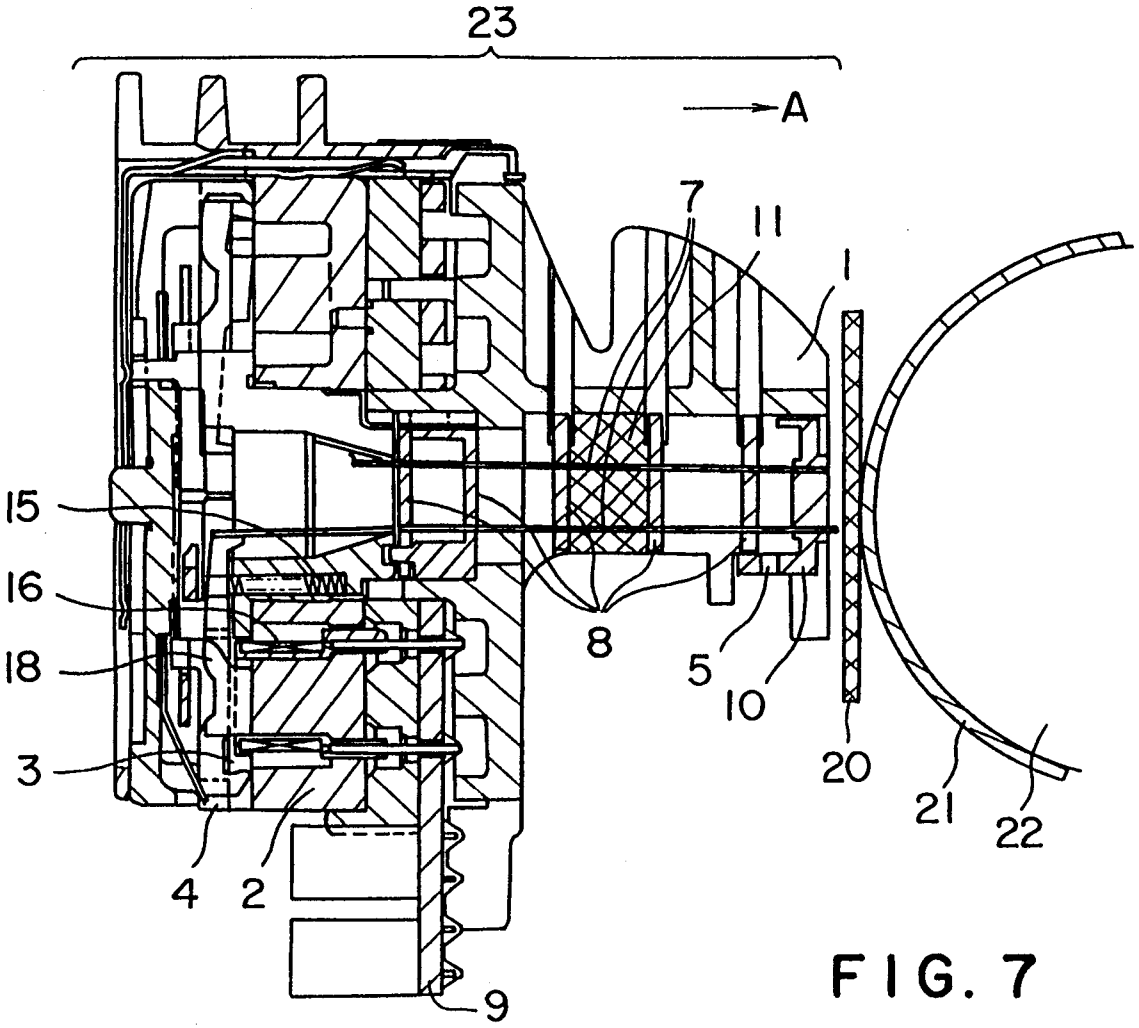
FIG. 7 is a cross-sectional view of a head portion of the impact dot printer according to another embodiment of the present invention.

Another embodiment of a head portion in a device favorable for use as the impact dot printer according to the present invention is shown in FIG. 7. This embodiment is the same as the above embodiment except for the method of injecting a lubricant. In the above embodiment, a lubricant is injected into the lubricant room 24. On the other hand, in the embodiment shown in FIG. 7, a felt 11 impregnated with a lubricant is inserted into between intermediate guides 8 to reduce the sliding friction of the printing wire 7. Thus, since the lubricant is held in the felt 11, there is no need of providing a room for holding the lubricant.

Lubricant and Solvent for Ink

According to the first embodiment of the present invention, there is provided an impact dot printer in which a lubricant and a solvent for an ink satisfy a requirement that the solubility of an oil component of the lubricant in the solvent for an ink is 400 g/100 g of oil.

Although the reason for the occurrence of missing of dots observed in the impact dot printer is not bound by the following theory, it is believed as follows. The oil component of the lubricant travels along the printing wire 7 and adheres to the ink ribbon 20 (see FIG. 2). The oil component of a grease which has hitherto been used as a lubricant of the impact dot head is compatibilized with a solvent for an ink impregnated into the ink ribbon. On the other hand, the oil component of the grease does not sufficiently dissolve the ink dye. As a result, there occurs a portion where no ink dye exists (see FIG. 3). When the printing wire presses this portion against a recording paper, since no dye to be transferred exists, there occurs missing of dots.

According to the present invention, a combination that the oil component of the lubricant is less compatible with the solvent for the ink impregnated into the ink ribbon enables the oil component to be on the ink ribbon without impregnation into the ink ribbon even when the oil component adheres to the ink ribbon. Since there occurs no portion where no dye exists, missing of dots does not occur. When the solubility of the solvent for an ink in the oil component of the ink is 400 g/100 of oil, no missing of dots is observed. The solubility is preferably 200 g/100 g of oil or less, still preferably 100 g/100 g of oil or less.

In the present invention, preferred examples of the lubricant include a grease. The term "grease" used herein is intended to mean a semi-solid or solid lubricant which generally comprises an oil component and a thickening agent (for example, a metallic soap such as a sodium, potassium or lithium salt of a fatty acid). When the oil component of the grease is a mineral oil (for example, naphthene oil, paraffin oil or olefin oil), fatty acid esters, for example, oleic acid, oleic acid esters and caster oil, are preferably used. Methyl oleate or ethyl oleate is particularly preferred.

Further, a silicone grease or fluorogrease is preferred. A grease comprising $\gamma$-fluoropropylmethyl polysiloxane (fluorosilicone) as the oil component is particularly preferred. The oil component of the silicon grease or fluorogrease is not compatible with many solvents for an ink which dissolve the dye for an ink. In particular, the solubility of most of the above solvents for an ink in these oil components is 400 g/100 g of oil or less. Therefore, the silicone grease and fluorogrease is advantageous over a grease comprising a paraffinic oil as a base oil in that the range of selection of the solvent for an ink is wider.

Further, it is preferred to satisfy a requirement that the ink dye is less liable to dissolve in the oil component although this relationship is not more important than the relationship between the oil component and the solvent for an ink. This is because it is preferred for the ink dye in the ink ribbon to stop in the ink ribbon without migration to the oil component on the ink ribbon. In particular, the solubility of the ink dye in the oil component of the lubricant is preferably 1 g/100 g of oil or less.

Specific preferred examples of the ink dye include C.I. Solvent Black 22, Nigrosine Base and Aniline Black.

According to the second aspect of the present invention, there is provided an ink ribbon for an impact dot printer which has a lubricant containing an oil component for permitting a printing wire to be easily moved. The ink ribbon of the present invention comprises a ribbon and an ink composition which comprises a dye and a solvent for the dye and is impregnated into the ribbon, wherein the solubility of the solvent for the dye in the oil component of the lubricant provided in the printer is not more than 400 g/100 g of oil, preferably not more than 200 g/100 g of oil, still preferably not more than 100 g/100 g of oil.

According to the third aspect of the present invention, there is provided an impact dot printer having a grease, as a lubricant for permitting the printing wire to be easily moved, comprising an oil component and urea as a thickening agent. When urea is used as the thickening agent of the grease, the bleeding of the oil component on the side of the ink ribbon along the printing wire 7 can be prevented, so that no missing of dots occurs. The urea as the thickening agent constitutes a urea fiber structure in the grease and holds the oil component within the fiber structure. The urea forms a fiber structure having a higher strength than that formed by the conventional thickening agent of the grease. This prevents the fiber structure being easily broken by driving of the printing wire 7, which in turn prevents the fluidization of the grease so that the oil component does not ooze out on the side of the ink ribbon along the printing wire 7.

Since the strength of the urea fiber is less susceptible to the change of temperature, the change in the viscosity with the temperature is small. Thus, the influence of the grease on the driving of the printing wire 7 even under a low temperature condition and under a high temperature condition due to heat by means of the impact dot head 23 itself is constant, which enables a stable printing quality to be realized.

The composition of the grease is the same as that of the conventional grease, except that urea is used as the thickening agent.

According to the fourth aspect of the present invention, there is provided an impact dot printer having a black lubricant for permitting the printing wire to be easily moved. A black lubricant containing a black dye or pigment is preferred. The black lubricant contains, thus, a black oil component. When the black oil component adheres to an ink ribbon, the black oil component will record dots on the recording medium through a printing action of the printing wire. As the result, there is no missing of dots even when the oil component of the lubricant oozes out and adheres to the ink ribbon.

When a lubricant is not black, it is necessary that the lubricant be black. It is preferred for the blackening the grease to be conducted by adding a black dye or pigment to the grease. For example, a black grease may be prepared by a method which comprises mixing and dissolving a black dye or pigment in an oil component to prepare a black oil component and then mixing and dispersing a thickening agent in the black oil component to provide a black grease. Alternatively, a black grease may be prepared by adding a black dye or pigment to the grease.

The black dye or pigment is preferably soluble in an oil component. Particularly preferred examples thereof include C.I. Solvent Black 7 (Nigrosine Base).

It is also possible to use a lubricant having a low viscosity as the lubricant so that a given amount of a black lubricant always oozes out on the surface of the head guide 10 during printing or standing. This construction enables the black component to be always fed to the ink ribbon 20, so that the prolongation of service life of the ink ribbon can be expected.

Figure 5A:
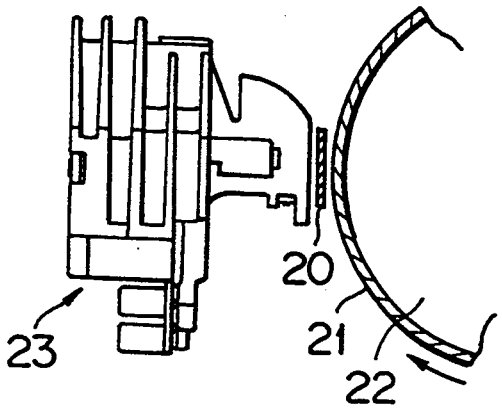
FIG. 5 is a diagram showing a mounted state of a head of the impact dot printer according to the present invention.
Figure 5B:
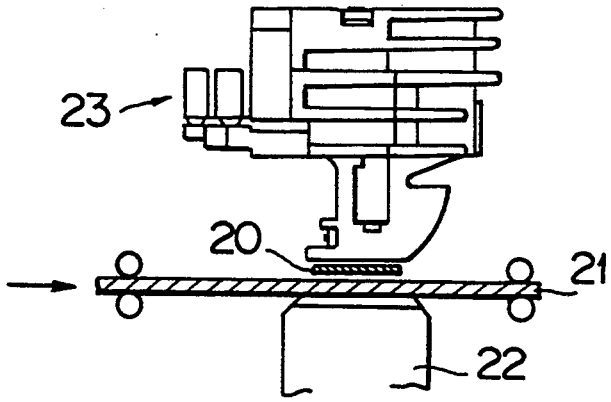
Figure 5C:
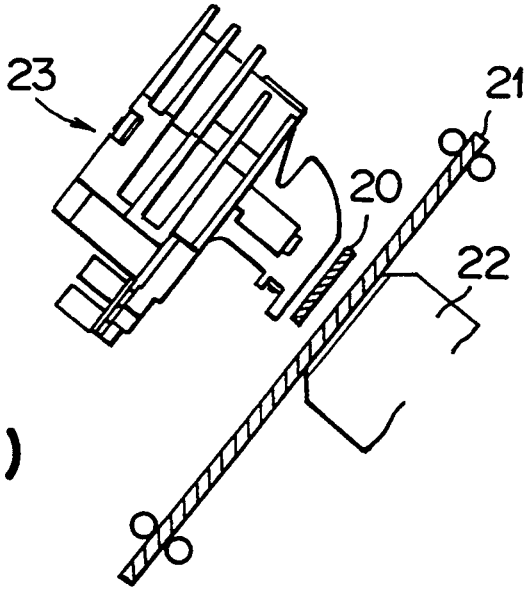
Figure 6:
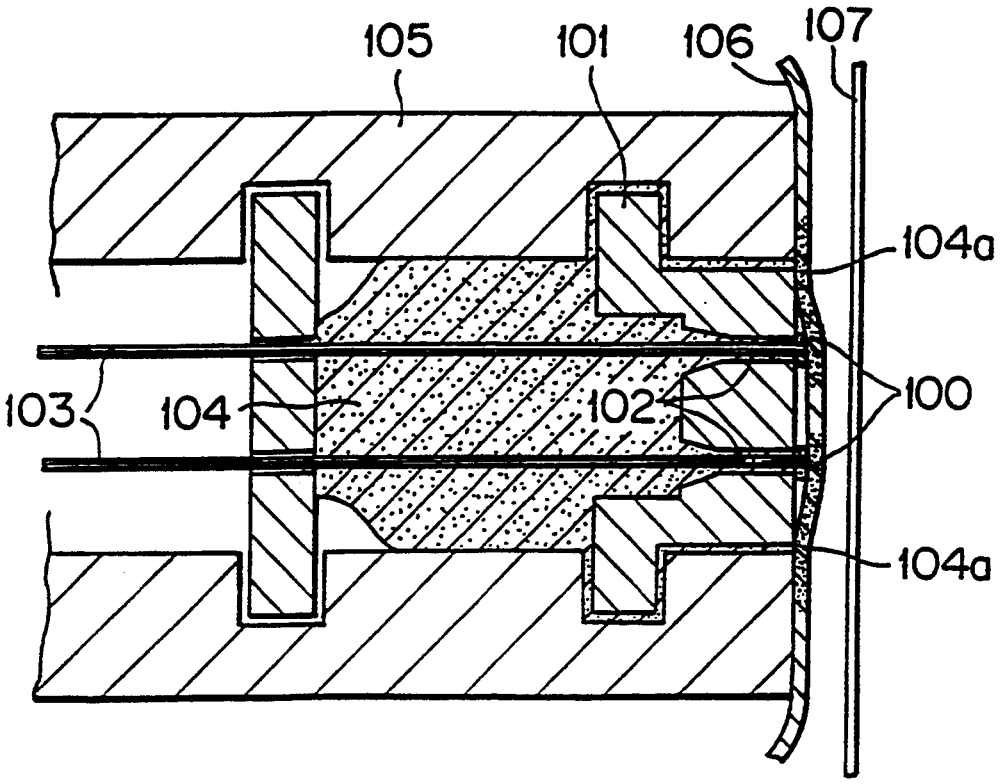
FIG. 6 is a diagram showing a mounted state of a head of a conventional impact dot printer.

The impact dot printer according to the present invention can be particularly advantageously used when the lubricant is susceptible to gravity and liable to adhere to the ink ribbon. As compared with a device in which an impact dot head is horizontally mounted (see FIG. 5 (*a*)), devices in which a head is positioned downward (see FIG. 5 (*b*)) or obliquely (see FIG. 5 (*c*)) are liable to occurrence of adhesion of the lubricant to the ink ribbon due to the influence of the gravity. Even in this construction, in the impact dot printer according to the present invention, no missing of dots occurs even when the lubricant adheres to the ink ribbon. Further, according to the impact dot printer according to the third aspect of the present invention, since no lubricant oozes out and adheres to the ink ribbon, no missing of dots advantageously occurs.

It will be apparent that the present invention is applicable also to other impact dot head than the above direction attraction type impact dot head, for example, a spring charger impact dot head and an impact dot head wherein use is made of a piezoelectric element.

The present invention will now be described in more detail with reference to the following Examples, though the present invention is not limited to these Examples only.

EXAMPLE 1

In an impact dot head shown in FIG. 1, a grease comprising a paraffinic oil (a paraffin oil) as a base oil was introduced through a lubricant injection port 5 provided on the head guide 10.

The ink ribbon used was one impregnated with a solution of a dye C.I. Solvent Black 22 dissolved in methyl oleate.

The solubility of methyl oleate in the paraffin oil, which is the oil component of the grease, was determined by adding methyl oleate to the paraffin oil until two-phase separation was attained, and found to be about 350 g/100 g of oil.

When printing was conducted by using the impact dot head shown in FIG. 1, missing of dots was not observed at all.

EXAMPLE 2

An impact dot head was constructed in the same manner as that of Example 1, except that a grease comprising a paraffinic oil (a paraffin oil) as a base oil was used as the lubricant and ethyl oleate was used as the solvent instead of methyl oleate.

The solubility of ethyl oleate in the paraffin oil, which is the oil component of the grease, was determined in the same manner as that of Example 1, and found to be about 400 g/100 g of oil.

Printing was conducted by using this device in the same manner as that of Example 1. As a result, missing of dots was not observed at all.

EXAMPLE 3

An impact dot head was constructed in the same manner as that of Example 1, except that a silicone grease comprising a fluorosilicone oil as a base oil was used as the lubricant and ethyl oleate was used as the solvent.

The solubility of ethyl oleate in the fluorosilicone oil, which is the oil component of the greaser was determined in the same manner as that of Example 1, and found to be about 70 g/100 g of oil.

Printing was conducted by using this device in the same manner as that of Example 1. As a result, missing of dots was not observed at all.

COMPARATIVE EXAMPLE 1

An impact dot head was constructed in the same manner as that of Example 1, except that hexyl oleate was used as the solvent instead of methyl oleate.

The solubility of hexyl oleate in the paraffin oil, which is the oil component of the grease, and determined in the same manner as that of Example 1, and found to be about 570 g/100 g of oil.

Printing was conducted by using this device in the same manner as that of Example 1. As a result, missing of dots was observed in a proportion of about 100%. The inspection of the ink ribbon at its portions corresponding to portions where missing of dots occurred has revealed that the oil component of the grease adhered to the ink ribbon and missing of the dye was observed.

COMPARATIVE EXAMPLE 2

An impact dot head was constructed in the same manner as that of Example 1, except that butyl oleate was used as the solvent instead of methyl oleate.

The solubility of butyl oleate in the paraffin oil, which is the oil component of the grease, was determined in the same manner as that of Example 1, and found to be about 525 g/100 g of oil.

Printing was conducted by using this device in the same manner as that of Example. 1 As a result, missing of dots was observed in a proportion of about 50%. The inspection of the ink ribbon of its portions corresponding to portions where missing of dots occurred has revealed that the oil component of the grease adhered to the ink ribbon and missing of the dye was observed.

COMPARATIVE EXAMPLE 3

An impact dot head was constructed in the same manner as that of Example 1, except that propyl oleate was used as the solvent instead of methyl oleate. '

The solubility of propyl oleate in the paraffin oil, which is the oil component of the grease, was determined, and found to be about 450 g/100 g of oil.

Printing was conducted by using this device in the same manner as that of Example 1. As a result, missing of dots was observed in a proportion of about 10%. The inspection of the ink ribbon at its portions corresponding to portions where missing of dots occurred has revealed that the oil component of the grease adhered to the ink ribbon and missing of the dye was observed.

What is claimed is:

1. An impact dot printer for recording dots on a recording medium, comprising:

a printing wire having a printing end;

a guide member for supporting the printing wire, the guide member having a lubricant containing an oil component for permitting the printing wire to be easily moved;

an ink ribbon positioned between the printing end of the printing wire and the recording medium, the ink ribbon containing an ink composition comprising a dye and a solvent for the dye; and a drive means for driving the printing wire in response to a printing signal so that the printing end of the wire impacts the ink ribbon to the recording medium thereby recording a dot on the medium, wherein the solubility of the solvent for the dye in the component of the lubricant is not more than 400 g/100 g of oil.

2. An impact dot printer according to claim 1, wherein the lubricant is a grease comprising a paraffinic oil as a base oil, and the solvent for the dye is selected from the group consisting of methyl oleate and ethyl oleate.

3. An impact dot printer according to claim 1, wherein the solubility of the dye in the ink composition in the oil component of the lubricant is not more than 1 g/100 g of oil.

4. An impact dot printer according to claim 1, wherein the lubricant is a member selected from the group consisting of a silicone grease and a fluorogrease.

5. An ink ribbon for an impact dot printer comprising:

a ribbon; and an ink composition comprising a dye and a solvent for the dye, the ink composition being impregnated into the ribbon, wherein the solubility the solvent for the dye in an oil component of a lubricant is not more than 400 g/100 g of oil.

6. An ink ribbon according to claim 5, wherein the lubricant is a grease comprising a paraffinic oil as a base oil, and the solvent for the dye is selected from the group consisting of methyl oleate and ethyl oleate.

7. An ink ribbon according to claim 5, wherein the solubility of the dye in the ink composition in the oil component of the lubricant is not more than 1 g/100 g of oil.

8. An ink ribbon according to claim 5, wherein the lubricant is selected from the group consisting of a silicone grease and a fluorogrease.

9. In a impact dot printer for recording dots on a recording medium, the improvements comprising:

a printing wire having a printing end;

a guide member for supporting the printing wire, said guide member having a lubricant for permitting the printing wire to be easily moved, the lubricant comprising a grease comprising an oil component and urea as a thickening agent;

an ink ribbon positioned between the printing end and the recording medium; and a drive means for driving the printing wire in response to a printing signal so that the printing end of the wire impacts the ink ribbon to the recording medium, thereby recording a dot on the medium.

10. An impact dot printer for recording dots on a recording medium, comprising:

a printing wire having a printing end;

a guide member for supporting the printing wire having an initially black lubricant for permitting the printing wire to be easily moved;

an ink-containing ribbon positioned between the printing end of the printing wire and the recording medium; and a drive means for driving the printing wire in response to a printing signal so that the printing end of the wire impacts the ribbon to the recording medium and records with at least one of the lubricant and ink a dot on the medium.

11. An impact dot printer according to claim 10, wherein the black lubricant contains a black dye.

* * * * *